US007464028B2

(12) United States Patent
Singhal

(10) Patent No.: US 7,464,028 B2
(45) Date of Patent: Dec. 9, 2008

(54) SYSTEM AND METHOD FOR FREQUENCY DOMAIN AUDIO SPEED UP OR SLOW DOWN, WHILE MAINTAINING PITCH

(75) Inventor: Manoj Kumar Singhal, Bangalore (IN)

(73) Assignee: Broadcom Corporation, Irvine, CA (US)

( * ) Notice: Subject to any disclaimer, the term of this patent is extended or adjusted under 35 U.S.C. 154(b) by 793 days.

(21) Appl. No.: 10/803,416

(22) Filed: Mar. 18, 2004

(65) Prior Publication Data

US 2005/0209846 A1 Sep. 22, 2005

(51) Int. Cl.
*G10L 19/00* (2006.01)

(52) U.S. Cl. ..... 704/205

(58) Field of Classification Search ..... 704/205
See application file for complete search history.

(56) References Cited

U.S. PATENT DOCUMENTS 6,088,313 A * 7/2000 Tanaka ..... 369/47.23

6,266,643 B1 * 7/2001 Canfield et al. ..... 704/278

OTHER PUBLICATIONS

Quatieri "Discrete-Time Speech Processing" Prentice Hall, 2002, pp. 595-597.*

* cited by examiner

*Primary Examiner*—Susan McFadden
(74) *Attorney, Agent, or Firm*—McAndrews Held & Malloy, Ltd.

(57) ABSTRACT

Presented herein are system(s) and method(s) for frequency domain audio speed up or slow down, while maintaining pitch. An encoded audio signal is received. Frames from the encoded audio signal are retrieved. The frames of the audio signal are transformed into a frequency domain, wherein each of said frames are associated with a plurality of initial phases, and a corresponding plurality of ending phases. The initial phases of at least one of the frames are replaced with the ending phases of another frame.

13 Claims, 7 Drawing Sheets

213

| | | | | |
|---|---|---|---|---|
| $F_0(0)\ldots F_0(1023)$ | $F_1(0)\ldots F_1(1023)$ | $F_2(0)\ldots F_2(1023)$ | -------- | $F_n(0)\ldots F_n(1023)$ |

212

| | | | | |
|---|---|---|---|---|
| $FR_0(0)\ldots FR_0(1023)$ | $FR_1(0)\ldots FR_1(1023)$ | $FR_2(0)\ldots FR_2(1023)$ | -------- | $FR_n(0)\ldots FR_n(1023)$ |

214

| | | | | |
|---|---|---|---|---|
| $wF_0(0)\ldots wF_0(1023)$ | $wF_1(0)\ldots wF_1(1023)$ | $wF_2(0)\ldots wF_2(1023)$ | ------- | $wF_n(0)\ldots wF_n(1023)$ |

216

| | | | | |
|---|---|---|---|---|
| $W_0(f_0,f_1,f_2\ldots)$, $\theta_0(f_0,f_1,f_2\ldots)$, $\psi_0(f_0,f_1,f_2\ldots)$ | $w_1(f_0,f_1,f_2\ldots)$, $\theta_1(f_0,f_1,f_2\ldots)$, $\psi_1(f_0,f_1,f_2\ldots)$ | $w_2(f_0,f_1,f_2\ldots)$, $\theta_2(f_0,f_1,f_2\ldots)$, $\psi_2(f_0,f_1,f_2\ldots)$ | ------- | $w_n(f_0,f_1,f_2\ldots)$, $\theta_v(f_0,f_1,f_2\ldots)$, $\psi_v(f_0,f_1,f_2\ldots)$ |

218

| | | | | |
|---|---|---|---|---|
| $w_0(f_0,f_1,f_2\ldots)$, $\theta_0(f_0,f_1,f_2\ldots)$, $\psi_0(f_0,f_1,f_2\ldots)$ | $w_1(f_0,f_1,f_2\ldots)$, $\psi_0(f_0,f_1,f_2\ldots)$, $\psi'_1(f_0,f_1,f_2\ldots)$ | $w_2(f_0,f_1,f_2\ldots)$, $\psi'_1(f_0,f_1,f_2\ldots)$, $\psi'_2(f_0,f_1,f_2\ldots)$ | ------- | $w_n(f_0,f_1,f_2\ldots)$, $\psi'_{v-1}(f_0,f_1,f_2\ldots)$, $\psi'_v(f_0,f_1,f_2\ldots)$ |

220

| | | | | |
|---|---|---|---|---|
| $wF_0(0)'\ldots wF_0(1023)'$ | $wF_1(0)'\ldots wF_1(1023)'$ | $wF_2(0)'\ldots wF_2(1023)'$ | ------ | $wF_n(0)'\ldots wF_n(1023)'$ |

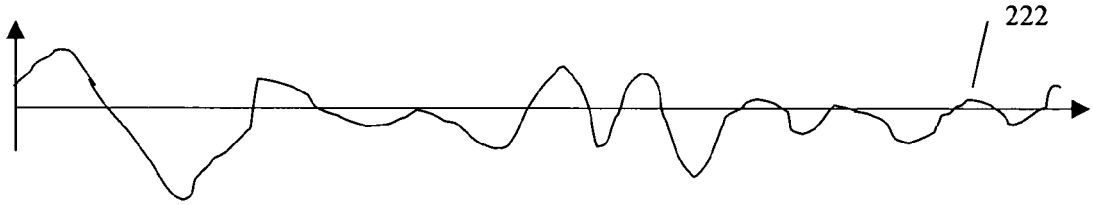

FIGURE 2

SYSTEM AND METHOD FOR FREQUENCY DOMAIN AUDIO SPEED UP OR SLOW DOWN, WHILE MAINTAINING PITCH

RELATED APPLICATIONS

This application is related to Manoj Kumar Singhal, et al. U.S. application Ser. No. 10/803,286 entitled "System and Method for Time Domain Audio Slow Down, While Maintaining Pitch" filed Mar. 18, 2004, the complete subject matter of which is hereby incorporated herein by reference, in its entirety.

This application is also related to Manoj Kumar Singhal, et al. U.S. application Ser. No. 10/803,420 entitled "System and Method for Time Domain Audio Speed Up, While Maintaining Pitch" filed Mar. 18, 2004, the complete subject matter of which is hereby incorporated herein by reference, in its entirety.

FEDERALLY SPONSORED RESEARCH OR DEVELOPMENT

Not Applicable

MICROFICHE/COPYRIGHT REFERENCE

Not Applicable

BACKGROUND OF THE INVENTION

In many audio applications, an audio signal may be modified or processed to achieve a desired characteristic or quality. One of the characteristics of an audio signal that is frequently processed or modified is the speed of the signal. When sounds are recorded, they are often recorded at the normal speed and frequency at which the source plays or produces the signal. When the speed of the signal is modified, however, the frequency often changes, which may be noticed in a changed pitch. For example, if the voice of a woman is recorded at a normal level then played back at a slower rate, the woman's voice will resemble that of a man, or a voice at a lower frequency. Similarly, if the voice of a man is recorded at a normal level then played back at a faster rate, the man's voice will resemble that of a woman, or a voice at a higher frequency.

Some applications may require that an audio signal be played at a slower rate, while maintaining the same frequency, i.e. keeping the pitch of the sound at the same level as when played back at the normal speed.

Further limitations and disadvantages of conventional and traditional approaches will become apparent to one of ordinary skill in the art through comparison of such systems with the present invention as set forth in the remainder of the present application with reference to the drawings.

BRIEF SUMMARY OF THE INVENTION

Presented herein are system(s) and method(s) for frequency domain audio speed up or slow down, while maintaining pitch.

In one embodiment, there is presented a method for changing the speed of an encoded audio signal. The method comprises receiving the encoded audio signal; retrieving frames from the encoded audio signal; transforming the frames of the audio signal into a frequency domain, wherein each of said frames are associated with a plurality of initial phases, and a corresponding plurality of ending phases; and replacing the initial phases of at least one of the frames with the ending phases of another frame.

In another embodiment, there is presented a machine readable storage. The machine-readable storage has stored thereon, a computer program having at least one code section that changes the speed of an encoded audio signal. The at least one code section is executable by a machine, causing the machine to receive the encoded audio signal; retrieve frames from the encoded audio signal; transform the frames of the audio signal into a frequency domain, wherein each of said frames are associated with a plurality of initial phases, and a corresponding plurality of ending phases; and replace the initial phases of at least one of the frames with the ending phases of another frame.

In another embodiment, there is presented a system that changes the speed of an encoded audio signal. The system comprises a first circuit, a second circuit, a third circuit, and a fourth circuit. The first circuit receives the encoded audio signal. The second circuit retrieves frames from the encoded audio signal. The third circuit transforms the frames of the audio signal into a frequency domain, wherein each of said frames are associated with a plurality of initial phases, and a corresponding plurality of ending phases. The fourth circuit replaces the initial phases of at least one of the frames with the ending phases of another frame.

These and other features and advantages of the present invention may be appreciated from a review of the following detailed description of the present invention, along with the accompanying figures in which like reference numerals refer to like parts throughout.

BRIEF DESCRIPTION OF SEVERAL VIEWS OF THE DRAWINGS

FIG. 2 illustrates a block diagram of an exemplary time-domain decoding of an audio signal, in accordance with an embodiment of the present invention.

DETAILED DESCRIPTION OF THE INVENTION

The present invention relates generally to audio decoding. More specifically, this invention relates to decoding of audio signals to obtain an audio signal at a different speed while maintaining the same pitch as the original audio signal. Although aspects of the present invention are presented in terms of a generic audio signal, it should be understood that the present invention may be applied to many other types of systems.

Figure 1:
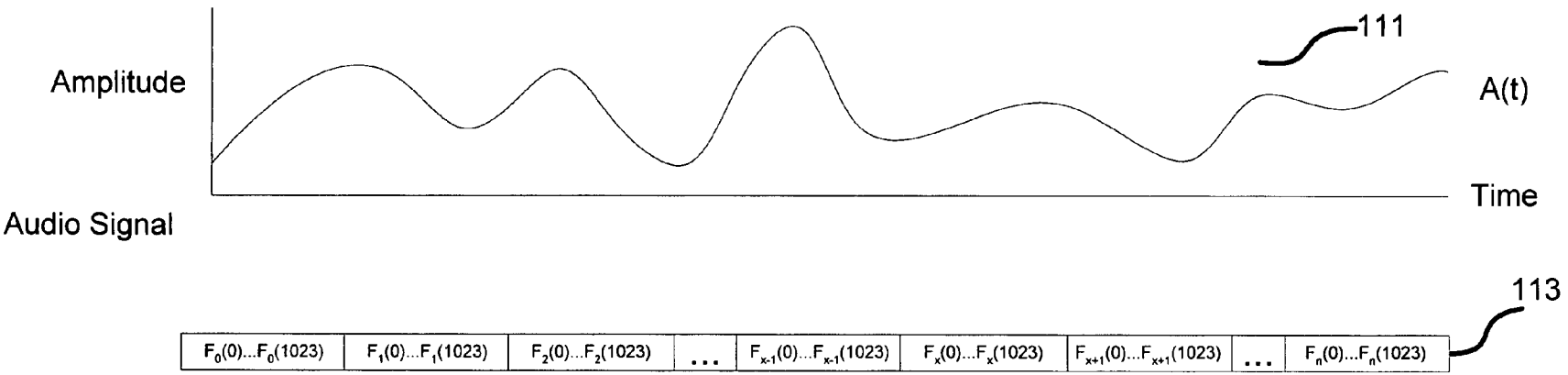
FIG. 1 illustrates a block diagram of an exemplary time-domain encoding of an audio signal, in accordance with an embodiment of the present invention.

FIG. 1 illustrates a block diagram of an exemplary time-domain encoding of an audio signal 111, in accordance with an embodiment of the present invention. The audio signal 111 is captured and sampled to convert it from analog-to-digital format using, for example, an audio to digital converter (ADC). The samples of the audio signal 111 are then grouped into frames 113 ($F_0 \ldots F_n$) of 1024 samples such as, for example, ($F_x(0) \ldots F_x(1023)$). The frames 113 are then encoded according to one of many encoding schemes depending on the system.

FIG. 2 illustrates a block diagram of an exemplary time-domain decoding of an audio signal, in accordance with an embodiment of the present invention. In an embodiment of the present invention, the input to the decoder is frames 213 ($F_0 \ldots F_n$) of 1024 samples such as, for example, frames 113 ($F_0 \ldots F_n$) of 1024 samples of FIG. 1.

The frames 213 ($F_0 \ldots F_n$) are then replicated or skipped at a rate consistent with the desired slow rate. For example, if the desired audio speed is half the original speed, then each frame is repeated, resulting in frames 212 If the desired audio speed is twice the original speed, then every other frame is skipped, resulting in frames 212 ($FR_0 \ldots FR_m$) of 1024 samples, where $FR_0=F_0$, $FR_1=F_2$, and $FR_2=F_4$, etc. Additionally, m depends on the desired slow rate. In the example, where the desired audio speed is half the original speed, m=2n. If, for example, the desired audio speed is two-thirds of the original speed, then every other frame is repeated, so frames 213 ($F_0 \ldots F_n$) result in frames ($FR_0 \ldots FR_m$), where $FR_0=F_0$, $FR_1=FR_2=F_1$, $FR_3=F_2$, $FR_4=FR_5=F_3$, etc., and m=3n/2. If for example, the desired audio speed is 1.5 times the original speed, then every third frame is skipped. Accordingly, frames 213 ($F_0 \ldots F_n$) result in frames ($FR_0 \ldots FR_m$), where $FR_0=F_0$, $FR_1=F_1$, $FR_2=F_3$, $FR_3=F_4$, $FR_4=F_6$, etc.

A window function WF is then applied to frames 212 ($FR_0 \ldots FR_m$) to "smooth out" the samples and ensure that the resulting signal does not have any artifacts that may result from repeating each frame. The window function results in the windowed frames 214 ($WF_0 \ldots WF_L$) of 1024 samples. The window function WF can be one of many widely known and used window functions, or can be designed to accommodate the requirements of the system.

The Discrete Fourier Transformation (DFT) is then applied to the windowed frames 214. Application of DFT to the windowed frames 214 results in frequency domain windowed samples 216. The frequency domain windowed samples 216 are generally a collection of amplitudes $W(f_0, f_1, f_2, \ldots)$, and initial phases $\Theta(f_0, f_1, f_2, \ldots)$ corresponding to a plurality of frequencies. Accordingly, the frequency domain windowed samples 216 can be expressed as:

$$w(f_0)\cos(f_0+\Theta(f_0))$$

$$w(f_1)\cos(f_1+\Theta(f_1))$$

$$w(f_2)\cos(f_2+\Theta(f_2))$$

Each of the plurality of frequencies also correspond to an ending phase $\Psi(f_0, f_1, f_2, \ldots)$. The ending phases $\Psi(f_0, f_1, f_2, \ldots)$ are the phases of the corresponding frequencies at the ending boundary of the frame F, and are generally a function of the initial phases $\Theta(f)$, the frequency f, and the length of time represented by the frame.

The initial phases $\Theta_1(f_0, f_1, f_2, \ldots)$ of frame $F_1$ for each frequency are replaced with the ending phases $\Psi_0(f_0, f_1, f_2, \ldots)$ in frame $F_0$ for the corresponding frequencies. Because the ending phases $\Psi_1(f_0, f_1, f_2, \ldots)$ are dependent on the initial phases, changing the initial phases $\Theta_1(f_0, f_1, f_2, \ldots)$ with the ending phases $\Psi_0(f_0, f_1, f_2 \ldots)$ in frame $F_0$ will result in a new set of ending phases $\Psi_1'(f_0, f_1, f_2, \ldots)$. The initial phases of $\Theta_2(f_0, f_1, f_2 \ldots)$ of frame $F_2$ are replaced with the new set of ending phases of $\Psi_1'(f_0, f_1, f_2 \ldots)$ of frame $F_1$. The foregoing process will result in a new set of frequency domain windowed samples 218 that can be expressed as:

$$W_n(f_0)\cos(f_0+\Psi_{n-1}'(f_0))$$

$$W_n(f_1)\cos(f_1+\Psi_{n-1}'(f_1))$$

$$W_n(f_2)\cos(f_2+\Psi_{n-1}'(f_2))$$

The Inverse DFT (IDFT) is applied to the frequency domain windowed samples 218, resulting in windowed frames 220. The windowed frames 220 ($WF_0 \ldots WF_L$) of 1024 samples are then run through a digital-to-analog converter (DAC) to get an analog signal 201. The analog signal 211 is a longer version of the analog input signal 111 of FIG. 1 (analog signal 211 and analog signal 111 are not equal). When the analog signal 211 is played at the same frequency as the original signal 111 of FIG. 1, the speed, in the example with repeating each frame, is effectively half the speed at which the original audio was but the pitch remains the same, since the playback frequency remains unchanged. Hence, a slower audio playback is achieved without affecting the pitch.

Figure 3:
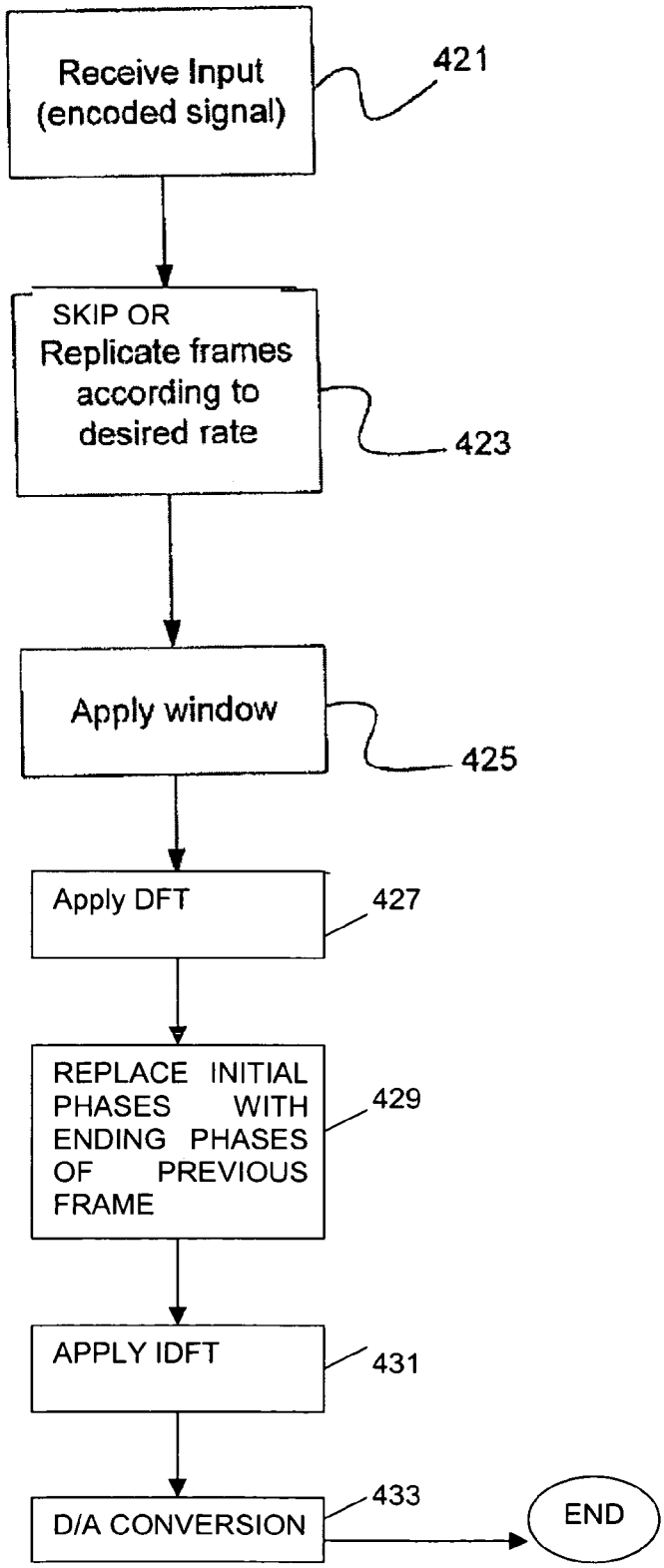
FIG. 3 illustrates a flow diagram of an exemplary method for time-domain decoding of an audio signal, in accordance with an embodiment of the present invention.

FIG. 3 illustrates a flow diagram of an exemplary method for time-domain decoding of an audio signal, in accordance with an embodiment of the present invention. At a starting block 421, an input is received from the encoder directly, using a storage device, or through a communication medium. The input, which is coming from the encoder, is frames ($F_0 \ldots F_n$). Then depending on the rate at which the audio signal needs to be slowed down, or speeded up, the proper number of frames are replicated or skipped at a next block 423, as described above with reference to FIG. 2, resulting in the frames ($FR_0 \ldots FR_m$).

At a next block 425, a window function WF is applied to the frames ($FR_0 \ldots FR_m$) to "smooth out" the samples and ensure that the resulting signal does not have any artifacts that may result from repeating each frame. The window function results in the windowed frames ($WF_0 \ldots WF_L$). The window function WF can be one of many widely known and used window functions, or can be designed to accommodate the design requirements of the system.

The Discrete Fourier Transformation (DFT) is then applied (427) to the windowed frames 214. Application of DFT to the windowed frames 214 results in frequency domain windowed samples 216. The frequency domain windowed samples 216 are generally a collection of amplitudes $w(f_0, f_1, f_2, \ldots)$, and initial phases $\Theta(f_0, f_1, f_2, \ldots)$ corresponding to a plurality of frequencies. Accordingly, the frequency domain windowed samples 216 can be expressed as:

$$w(f_0)\cos(f_0+\Theta(f_0))$$

$$w(f_1)\cos(f_1+\Theta(f_1))$$

$$w(f_2)\cos(f_2+\Theta(f_2))$$

Each of the plurality of frequencies also correspond to an ending phase $\Psi(f_0, f_1, f_2, \ldots)$. The ending phases $\Psi(f_0, f_1, f_2, \ldots)$ are the phases of the corresponding frequencies at the ending boundary of the frame F, and are generally a function of the initial phases $\Theta(f)$, the frequency f, and the length of time represented by the frame.

The initial phases $\Theta_1(f_0, f_1, f_2, \ldots)$ of frame $F_1$ for each frequency are replaced (429) with the ending phases $\Psi_0(f_0, f_1, f_2, \ldots)$ in frame $F_0$ for the corresponding frequencies. Because the ending phases $\Psi_1(f_0, f_1, f_2, \ldots)$ are dependent on the initial phases, changing the initial phases $\Theta_1(f_0, f_1,$ $f_2 \ldots$ ) with the ending phases $\Psi_0(f_0, f_1, f_2, \ldots)$ in frame $F_0$ will result in a new set of ending phases $\Psi_1'(f_0, f_1, f_2, \ldots)$. The initial phases of $\Theta_2(f_0, f_1, f_2, \ldots)$ of frame $F_2$ are replaced with the new set of ending phases of $\Psi_1'(f_0, f_1, f_2 \ldots)$ of frame $F_1$. The foregoing process will result in a new set of frequency domain windowed samples 218 that can be expressed as:

$$W_n(f_0)\cos(f_0+\Psi_{n-1}'(f_0))$$

$$W_n(f_1)\cos(f_1+\Psi_{n-1}'(f_1))$$

$$W_n(f_2)\cos(f_2+\Psi_{n-1}'(f_2))$$

The Inverse DFT (IDFT) is applied (431) to the frequency domain windowed samples 218, resulting in windowed frames 220. The windowed frames ($WF_0 \ldots WF_L$) are then sent through the DAC at a next block 433 to produce the audio signal at the desired slower or faster speed, with the same pitch as the original because the playback frequency is kept the same as the original signal.

Standards such as, for example, MPEG-1, Layer 3 (MPEG stands for Motion Pictures Experts Group) have been devised for compressing audio signals. In certain embodiments of the present invention, the audio signal can be compressed in accordance with such standards for compressing audio signals.

Figure 4:
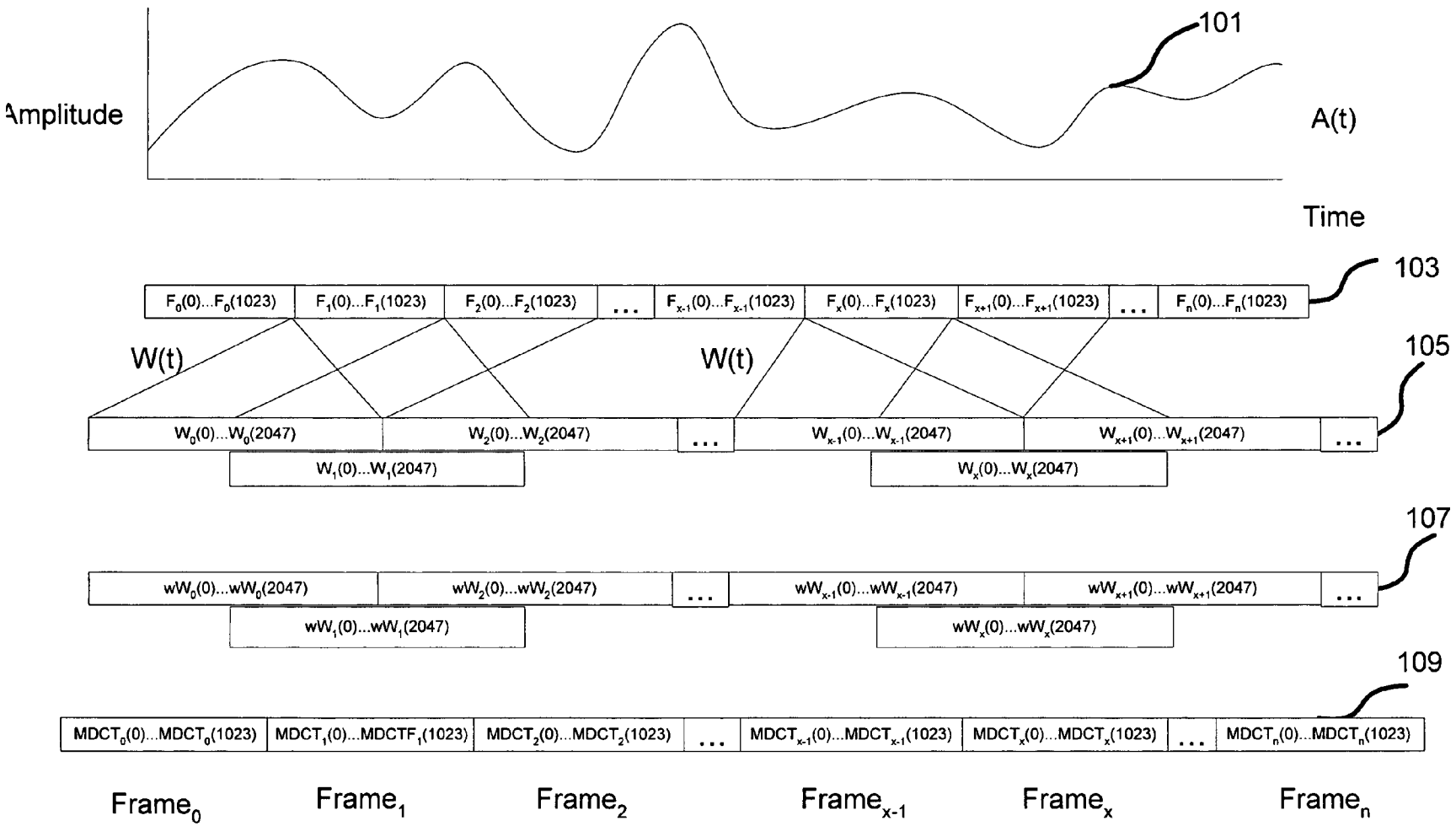
FIG. 4 illustrates a block diagram of an exemplary frequency-domain encoding of an audio signal, in accordance with an embodiment of the present invention.

FIG. 4 illustrates a block diagram describing the encoding of an audio signal 101, in accordance with the MPEG-1, Layer 3 standard. The audio signal 101 is captured and sampled to convert it from analog-to-digital format using, for example, an audio to digital converter (ADC). The samples of the audio signal 101 are then grouped into frames 103 ($F_0 \ldots F_n$) of 1024 samples such as, for example, ($F_x(0) \ldots F_x(1023)$).

The frames 103 ($F_0 \ldots F_n$) are then grouped into windows 105 ($W_0 \ldots W_n$) each one of which comprises 2048 samples or two frames such as, for example, ($W_x(0) \ldots W_x(2047)$) comprising frames ($F_x(0) \ldots F_x(1023)$) and ($F_{x+1}(0) \ldots F_{x+1}(1023)$). However, each window 105 $W_x$ has a 50% overlap with the previous window 105 $W_{x-1}$. Accordingly, the first 1024 samples of a window 105 $W_x$ are the same as the last 1024 samples of the previous window 105 $W_{x-1}$. For example, $W_0=(W_0(0) \ldots W_0(2047))=(F_0(0) \ldots F_0(1023))$ and $(F_1(0) \ldots F_1(1023))$, and $W_1=(W_1(0) \ldots W_1(2047))=(F_1(0) \ldots F_1(1023))$ and $(F_2(0) \ldots F_2(1023))$. Hence, in the example, $W_0$ and $W_1$ contain frames $(F_1(0) \ldots F_1(1023))$.

A window function w(t) is then applied to each window 105 ($W_0 \ldots W_n$) resulting in sets ($wW_0 \ldots wW_n$) of 2048 windowed samples 107 such as, for example, ($wW_x(0) \ldots wW_x(2047)$). A modified discrete cosine transform (MDCT) is then applied to each set ($wW_0 \ldots wW_n$) of windowed samples 107 ($wW_x(0) \ldots wW_x(2047)$), resulting sets ($MDCT_0 \ldots MDCT_n$) of 1024 frequency coefficients 109 such as, for example, ($MDCT_x(0) \ldots MDCT_x(1023)$).

The sets of frequency coefficients 109 ($MDCT_0 \ldots MDCT_n$) are then quantized and coded for transmission, forming an audio elementary stream (AES). The AES can be multiplexed with other AESs. The multiplexed signal, known as the Audio Transport Stream (Audio TS) can then be stored and/or transported for playback on a playback device. The playback device can either be at a local or remote location from the encoder. Where the playback device is remotely located, the multiplexed signal is transported over a communication medium such as, for example, the Internet. The multiplexed signal can also be transported to a remote playback device using a storage medium such as, for example, a compact disk.

During playback, the Audio TS is de-multiplexed, resulting in the constituent AES signals. The constituent AES signals are then decoded, yielding the audio signal. During playback the speed of the signal may be decreased to produce the original audio at a slower speed.

Figure 5:
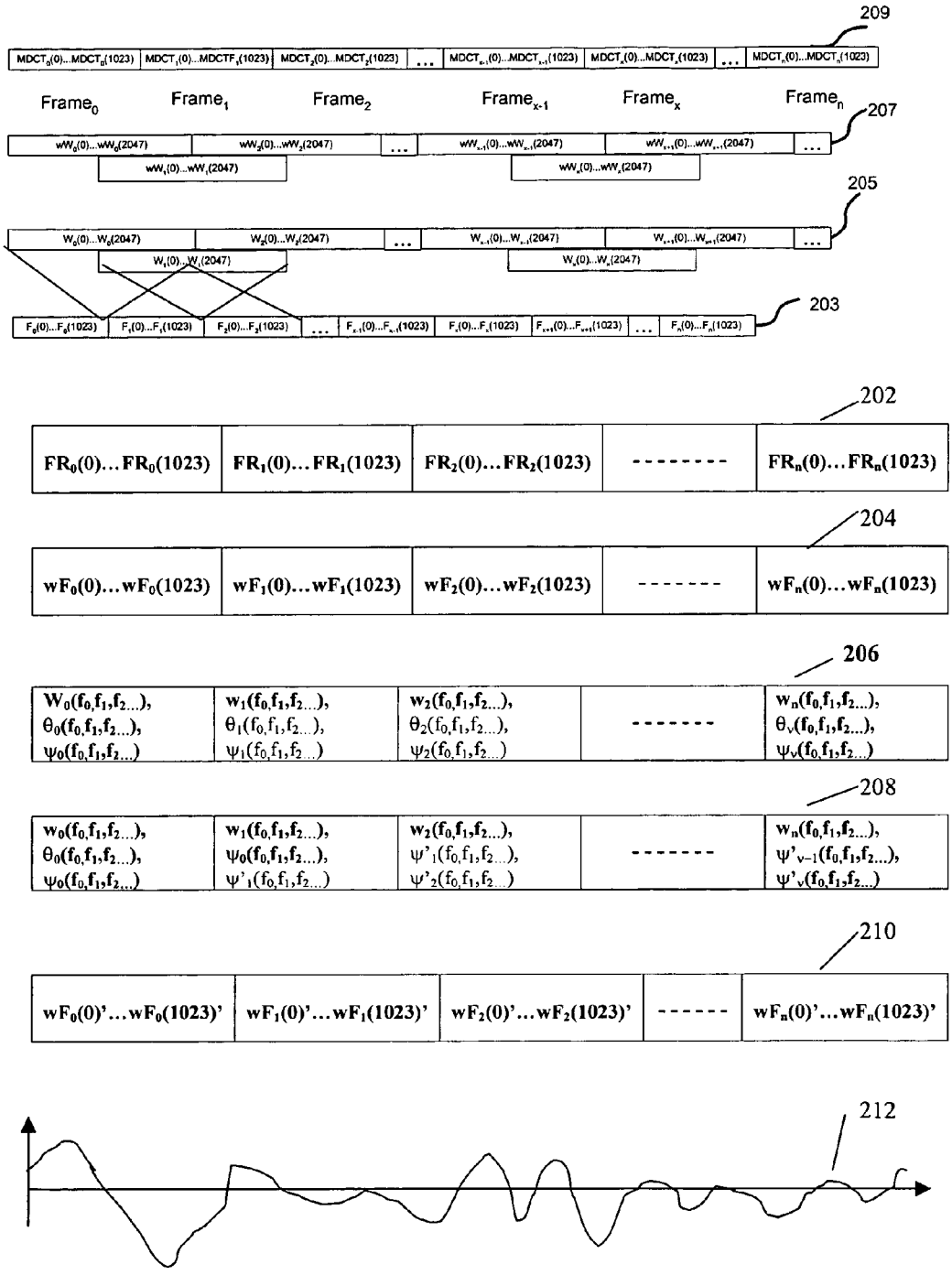
FIG. 5 illustrates a block diagram of an exemplary frequency-domain decoding of an audio signal, in accordance with an embodiment of the present invention.

FIG. 5 is a block diagram describing the decoding of an audio signal, in accordance with another embodiment of the present invention. In an embodiment of the present invention, the input to the decoder is sets ($MDCT_0 \ldots MDCT_n$) of 1024 frequency coefficients 209 such as, for example, the sets ($MDCT_0 \ldots MDCT_n$) of 1024 frequency coefficients 109 of FIG. 4. An inverse modified discrete cosine transform (IMDCT) is applied to each set ($MDCT_0 \ldots MDCT_n$) of 1024 frequency coefficients 209. The result of applying the IMDCT is the sets ($wW_0 \ldots wW_n$) of windowed samples 207 ($wW_x(0) \ldots wW_x(2047)$) equivalent to sets ($wW_0 \ldots wW_n$) of windowed samples 107 ($wW_x(0) \ldots wW_x(2047)$) of FIG. 4.

An inverse window function $w_I(t)$ is then applied to each set ($wW_0 \ldots wW_n$) of 2048 windowed samples 207, resulting in windows 205 ($W_0 \ldots W_n$) each one of which comprises 2048 samples. Each window 205 ($W_0 \ldots W_n$) comprises 2048 samples from two frames such as, for example, ($W_x(0) \ldots W_x(2047)$) comprising frames ($F_x)(0) \ldots F_x(1023)$) and ($F_{x+1}(0) \ldots F_{x+1}(1023)$) as illustrated in FIG. 4. The frames 203 ($F_0 \ldots F_n$) of 1024 samples such as, for example, ($F_x(0) \ldots F_x(1023)$), are then extracted from the windows 205 ($W_0 \ldots W_n$).

The frames 213 ($F_0 \ldots F_n$) are then replicated or skipped at a rate consistent with the desired slow rate. For example, if the desired audio speed is half the original speed, then each frame is repeated, resulting in frames 212 If the desired audio speed is twice the original speed, then every other frame is skipped, resulting in frames 212 ($FR_0 \ldots FR_m$) of 1024 samples, where $FR_0=F_0$, $FR_1=F_2$, and $FR_2=F_4$, etc. Additionally, m depends on the desired slow rate. In the example, where the desired audio speed is half the original speed, m=2n. If, for example, the desired audio speed is two-thirds of the original speed, then every other frame is repeated, so frames 213 ($F_0 \ldots F_n$) result in frames ($FR_0 \ldots FR_m$), where $FR_0=F_0$, $FR_1=FR_2=F_1$, $FR_3=F_2$, $FR_4=FR_5=F_3$, etc., and m=3n/2. If for example, the desired audio speed is 1.5 times the original speed, then every third frame is skipped. Accordingly, frames 213 ($F_0 \ldots F_n$) result in frames ($FR_0 \ldots FR_m$), where $FR_0=F_0$, $FR_1=F_1$, $FR_2=F_3$, $FR_3=F_4$, $FR_4=F_6$, etc.

A window function WF is then applied to frames 202 ($FR_0 \ldots FR_m$) to "smooth out" the samples and ensure that the resulting signal does not have any artifacts that may result from repeating each frame. The window function results in the windowed frames 204 ($WF_0 \ldots WF_L$) of 1024 samples. The window function WF can be one of many widely known and used window functions, or can be designed to accommodate the requirements of the system.

The Discrete Fourier Transformation (DFT) is then applied to the windowed frames 204. Application of DFT to the windowed frames 204 results in frequency domain windowed samples 206. The frequency domain windowed samples 206 are generally a collection of amplitudes $w(f_0, f_1, f_2, \ldots)$, and initial phases $\Theta(f_0, f_1, f_2, \ldots)$ corresponding to a plurality of frequencies. Accordingly, the frequency domain windowed samples 206 can be expressed as:

$$w(f_0)\cos(f_0+\Theta(f_0))$$

$$w(f_1)\cos(f_1+\Theta(f_1))$$

$$w(f_2)\cos(f_2+\Theta(f_2))$$

Each of the plurality of frequencies also correspond to an ending phase $\Psi(f_0, f_1, f_2, \ldots)$. The ending phases $\Psi(f_0, f_1, f_2, \ldots)$ are the phases of the corresponding frequencies at the ending boundary of the frame F, and are generally a function of the initial phases $\Theta(f)$, the frequency f, and the length of time represented by the frame.

The initial phases $\Theta_1(f_0, f_1, f_2, \ldots)$ of frame $F_1$ for each frequency are replaced with the ending phases $\Psi_0(f_0, f_1, f_2, \ldots)$ in frame $F_0$ for the corresponding frequencies. Because the ending phases $\Psi_1(f_0, f_1, f_2, \ldots)$ are dependent on the initial phases, changing the initial phases $\Theta_1(f_0, f_1, f_2, \ldots)$ with the ending phases $\Psi_0(f_0, f_1, f_2 \ldots)$ in frame $F_0$ will result in a new set of ending phases $\Psi_1'(f_0, f_1, f_2, \ldots)$. The initial phases of $\Theta_2(f_0, f_1, f_2, \ldots)$ of frame $F_2$ are replaced with the new set of ending phases of $\Psi_1'(f_0, f_1, f_2, \ldots)$ of frame $F_1$. The foregoing process will result in a new set of frequency domain windowed samples 208 that can be expressed as:

$$W_n(f_0)\cos(f_0+\Psi_{n-1}'(f_0))$$

$$W_n(f_1)\cos(f_1+\Psi_{n-1}'(f_1))$$

$$W_n(f_2)\cos(f_2+\Psi_{n-1}'(f_2))$$

The Inverse DFT (IDFT) is applied to the frequency domain windowed samples 208, resulting in windowed frames 210. The windowed frames 220 ($WF_0 \ldots WF_L$) of 1024 samples are then run through a digital-to-analog converter (DAC) to get an analog signal 212. The analog signal 201 is a longer version of the analog input signal 101 of FIG. 4 (analog signal 201 and analog signal 101 are not equal). When the analog signal 201 is played at the same frequency as the original signal 101 of FIG. 4, the speed, in the example with repeating each frame, is effectively half the speed at which the original audio was but the pitch remains the same, since the playback frequency remains unchanged. Hence, a slower audio playback is achieved without affecting the pitch.

Figure 6:
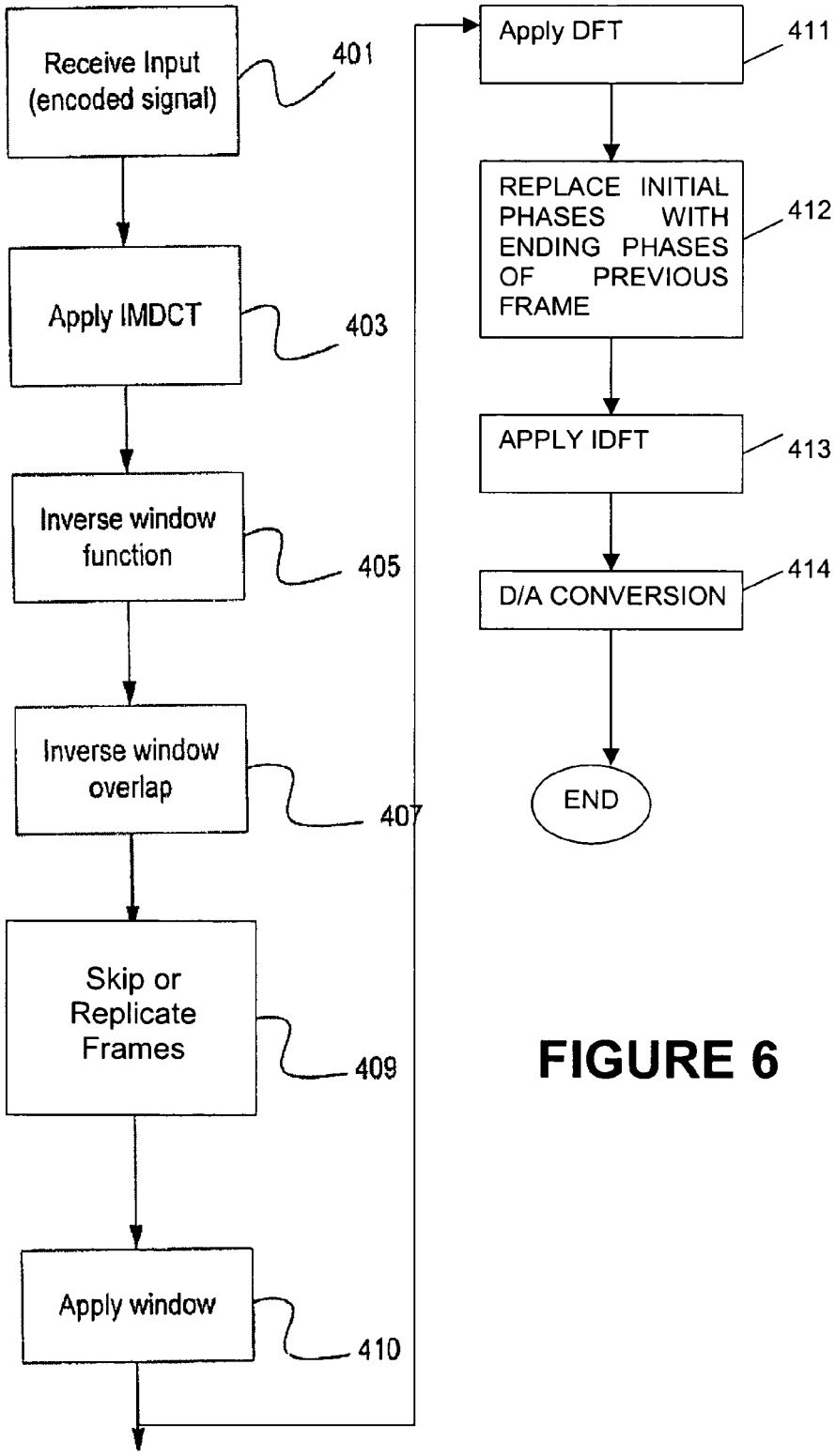
FIG. 6 illustrates a flow diagram of an exemplary method for frequency-domain decoding of an audio signal, in accordance with an embodiment of the present invention.

FIG. 6 illustrates a flow diagram of an exemplary method for frequency-domain decoding of an audio signal, in accordance with an embodiment of the present invention. At a starting block 401, an input is received from the encoder directly, using a storage device, or through a communication medium. The input, which is coming from the encoder, is quantized and coded sets of frequency coefficients of a MDCT ($MDCT_0 \ldots MDCT_n$). At a next block 403 the input is inverse modified discrete cosine transformed, yielding sets ($wW_0 \ldots wW_n$) of 2048 windowed samples. An inverse window function is then applied to the windowed samples at a next block 405 producing the windows ($W_0 \ldots W_n$) each of which comprises 2048 samples. The windows are the result of overlapping frames ($F_0 \ldots F_n$), which may be obtained by inverse overlapping the windows ($W_0 \ldots W_n$) at a next block 407. Then depending on the rate at which the audio signal needs to be slowed down or speeded up, the proper number of frames are replicated or skipped at a next block 409, as described above with reference to FIG. 5, resulting in the replicated frames ($FR_0 \ldots FR_m$).

At a next block 410, a window function WF is applied to the frames ($FR_0 \ldots FR_m$) to "smooth out" the samples and ensure that the resulting signal does not have any artifacts that may result from repeating each frame. The window function results in the windowed frames ($WF_0 \ldots WF_L$). The window function WF can be one of many widely known and used window functions, or can be designed to accommodate the requirements of the system.

The Discrete Fourier Transformation (DFT) is then applied (411) to the windowed frames 214. Application of DFT to the windowed frames 214 results in frequency domain windowed samples 216. The frequency domain windowed samples 216 are generally a collection of amplitudes $w(f_0, f_1, f_2, \ldots)$, and initial phases $\Theta(f_0, f_1, f_2, \ldots)$ corresponding to a plurality of frequencies. Accordingly, the frequency domain windowed samples 216 can be expressed as:

$$w(f_0)\cos(f_0+\Theta(f_0))$$

$$w(f_1)\cos(f_1+\Theta(f_1))$$

$$w(f_2)\cos(f_2+\Theta(f_2))$$

Each of the plurality of frequencies also correspond to an ending phase $\Psi(f_0, f_1, f_2, \ldots)$. The ending phases $\Psi(f_0, f_1, f_2, \ldots)$ are the phases of the corresponding frequencies at the ending boundary of the frame F, and are generally a function of the initial phases $\Theta(f)$, the frequency f, and the length of time represented by the frame.

The initial phases $\Theta_1(f_0, f_1, f_2, \ldots)$ of frame $F_1$ for each frequency are replaced (412) with the ending phases $\Psi_0(f_0, f_1, f_2, \ldots)$ in frame $F_0$ for the corresponding frequencies. Because the ending phases $\Psi_1(f_0, f_1, f_2, \ldots)$ are dependent on the initial phases, changing the initial phases $\Theta_1(f_0, f_1, f_2, \ldots)$ with the ending phases $\Psi_0(f_0, f_1, f_2 \ldots)$ in frame $F_0$ will result in a new set of ending phases $\Psi_1'(f_0, f_1, f_2 \ldots)$. The initial phases of $\Theta_2(f_0, f_1, f_2, \ldots)$ of frame $F_2$ are replaced with the new set of ending phases of $\Psi_1'(f_0, f_1, f_2, \ldots)$ of frame $F_1$. The foregoing process will result in a new set of frequency domain windowed samples 218 that can be expressed as:

$$W_n(f_0)\cos(f_0+\Psi_{n-1}'(f_0))$$

$$W_n(f_1)\cos(f_1+\Psi_{n-1}'(f_1))$$

$$W_n(f_2)\cos(f_2+\Psi_{n-1}'(f_2))$$

The Inverse DFT (IDFT) is applied (413) to the frequency domain windowed samples 218, resulting in windowed frames 220. The windowed frames ($WF_0 \ldots WF_L$) are then sent through the DAC at a next block 414 to produce the audio signal at the desired slower speed or faster speed, with the same pitch as the original because the playback frequency is kept the same as the original signal.

Figure 7:
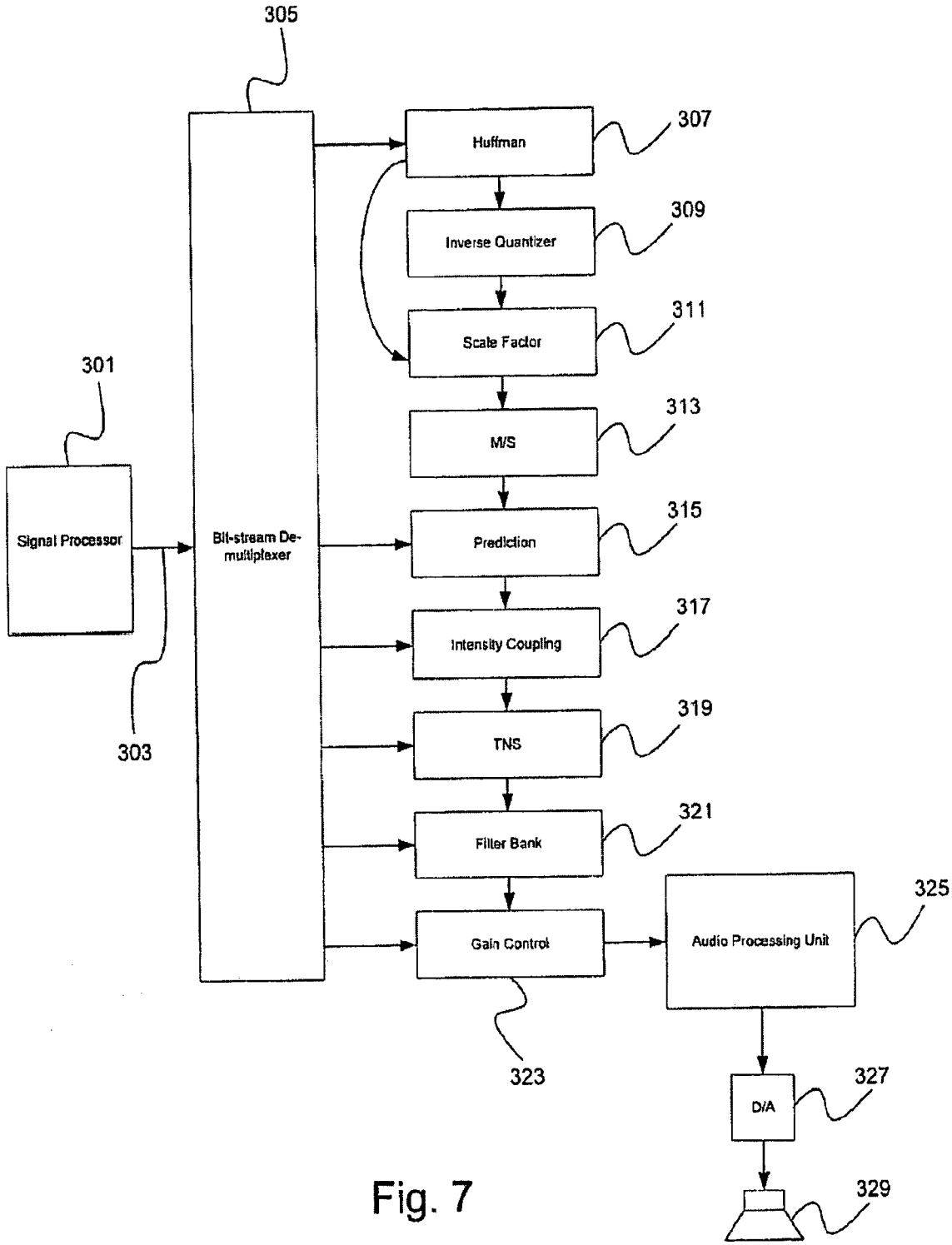
FIG. 7 illustrates a block diagram of an exemplary audio decoder, in accordance with an embodiment of the present invention.

FIG. 7 illustrates a block diagram of an exemplary audio decoder, in accordance with an embodiment of the present invention. The encoded audio signal is delivered from signal processor 301, and the advanced audio coding (AAC) bitstream 303 is de-multiplexed by a bit-stream de-multiplexer 305. This includes Huffman decoding 307, scale factor decoding 311, and decoding of side information used in tools such as mono/stereo 313, intensity stereo 317, TNS 319, and the filter bank 321.

The sets of frequency coefficients 109 ($MDCT_0 \ldots MDCT_n$) of FIG. 4 are decoded and copied to an output buffer in a sample fashion. After Huffman decoding 307, an inverse quantizer 309 inverse quantizes each set of frequency coefficients 109 ($MDCT_0 \ldots MDCT_n$) by a 4/3-power nonlinearity. The scale factors 311 are then used to scale sets of frequency coefficients 109 ($MDCT_0 \ldots MDCT_n$) by the quantizer step size.

Additionally, tools including the mono/stereo 313, prediction 315, intensity stereo coupling 317, TNS 319, and filter bank 321 can apply further functions to the sets of frequency coefficients 109 ($MDCT_0 \ldots MDCT_m$). The gain control 323 transforms the frequency coefficients 109 ($MDCT_0 \ldots MDCT_n$) into a time-domain audio signal. The gain control 323 transforms the frequency coefficients 109 by applying the IMDCT, the inverse window function, and inverse window overlap as explained above in reference to FIG. 5. If the signal is not compressed, then the IMDCT, the inverse window function, and the inverse window overlap are skipped, as shown in FIG. 2.

The output of the gain control 323, which is frames ($F_0 \ldots F_n$) such as, for example, frames 203 or frames 213, is then sent to the audio processing unit 325 for additional processing, playback, or storage. The audio processing unit 325 receives an input from a user regarding the speed at which the audio signal should be played or has access to a default value for the factor of slowing the audio signal at playback. The audio processing unit 325 then processes the audio signal according to the factor for slow playback by replicating the frames ($F_0 \ldots F_n$) at a rate consistent with the desired slow rate. For example, if the desired audio speed is half the original speed, then each frame is repeated, resulting in frames ($FR_0 \ldots FR_m$) such as, for example, frames 202 or frames 212, of 1024 samples, where $FR_0=FR_1=F_0$, and $FR_2=FR_3=F_1$, etc. The factor m depends on the desired slow rate. In the example, where the desired audio speed is half the original speed, m=2n. If, for example, the desired audio speed is two-thirds of the original speed, then every other frame is repeated, so frames ($F_0 \ldots F_n$) result in frames ($FR_0 \ldots FR_m$), where $FR_0=F_0$, $FR_1=FR_2=F_1$, $FR_3=F_2$, $FR_4=FR_5=F_3$, etc., and m=3n/2.

A window function WF is then applied to frames ($FR_0 \ldots FR_m$) to "smooth out" the samples and ensure that the resulting signal does not have any artifacts that may result from repeating each frame. The window function results in the windowed frames ($WF_0 \ldots WF_L$) such as, for example, frames 204 or frames 214, of 1024 samples. The window function WF can be one of many widely known and used window functions, or can be designed to accommodate the requirements of the system.

At this point the signal is still in digital form, so the output of the audio processing unit 325 is run through a DAC 327, which converts the digital signal to an analog audio signal to be played through a speaker 329.

In an embodiment of the present invention, the playback speed is pre-determined in the design of the decoder. In another embodiment of the present invention, the play back speed is entered by a user of the decoder, and varies accordingly.

The embodiments described herein may be implemented as a board level product, as a single chip, application specific integrated circuit (ASIC), or with varying levels of the decoder system integrated with other portions of the system as separate components. The degree of integration of the decoder system will primarily be determined by the speed and cost considerations. Because of the sophisticated nature of modern processor, it is possible to utilize a commercially available processor, which may be implemented external to an ASIC implementation. Alternatively, if the processor is available as an ASIC core or logic block, then the commercially available processor can be implemented as part of an ASIC device wherein certain functions can be implemented in firmware.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method for changing the speed of an encoded audio signal, said method comprising:

receiving the encoded audio signal;

retrieving frames from the encoded audio signal;

transforming the frames of the audio signal into a frequency domain, wherein each of said frames are associated with a plurality of initial phases, and a corresponding plurality of ending phases; and replacing the initial phases of at least one of the frames with the ending phases of another frame.

2. The method of claim 1, wherein retrieving frames further comprises:

repeating some of the frames, wherein a desired playback speed is slower than a speed associated with the encoded audio signal; and skipping some of the frames, wherein a desired playback speed is faster than the speed associated with the encoded audio signal.

3. The method according to claim 1 wherein the encoded original audio signal is encoded in the frequency domain using one of a plurality of encoding schemes, the method further comprising frequency-domain decoding of the encoded original audio signal.

4. The method according to claim 3 wherein said decoding comprises:

decoding said encoded signal using a decoding scheme corresponding to said one of a plurality of encoding schemes;

applying an inverse transform to the encoded audio signal; and applying an inverse window function.

5. The method according to claim 1 wherein the desired playback speed is a programmable value.

6. A machine-readable storage having stored thereon, a computer program having at least one code section that changes the speed of an encoded audio signal, the at least one code section being executable by a machine for causing the machine to perform operations comprising:

receiving the encoded audio signal;

retrieving frames from the encoded audio signal;

transforming the frames of the audio signal into a frequency domain, wherein each of said frames are associated with a plurality of initial phases, and a corresponding plurality of ending phases; and replacing the initial phases of at least one of the frames in the frequency domain with the ending phases of another frame.

7. The machine-readable storage according to claim 6, wherein retrieving frames further comprises:

repeating some of the frames, wherein a desired playback speed is slower than a speed associated with the encoded audio signal; and skipping some of the frames, wherein a desired playback speed is faster than the speed associated with the encoded audio signal.

8. The machine-readable storage according to claim 6 wherein the encoded original audio signal is encoded in the frequency domain using one of a plurality of encoding schemes, the machine-readable storage further comprising code for frequency-domain decoding of the encoded original audio signal.

9. The machine-readable storage according to claim 7 further comprising:

code for decoding said encoded signal using a decoding scheme corresponding to said one of a plurality of encoding schemes;

code for applying an inverse transform to the encoded audio signal; and code for applying an inverse window function.

10. The machine-readable storage according to claim 6 wherein the desired playback speed is a programmable value.

11. A system that changes the speed of an encoded audio signal, the system comprising:

a first circuit for receiving the encoded audio signal;

a second circuit for retrieving frames from the encoded audio signal;

a third circuit for transforming the frames of the audio signal into a frequency domain, wherein each of said frames are associated with a plurality of initial phases, and a corresponding plurality of ending phases; and a fourth circuit for replacing the initial phases of at least one of the frames with the ending phases of another frame.

12. The system according to claim 11 wherein the encoded audio signal is encoded in the frequency domain using one of a plurality of encoding schemes, the system further comprising a fifth circuit for frequency-domain decoding of the encoded original audio signal.

13. The system according to claim 11 wherein the desired playback speed is a programmable value.

* * * * *